United States Patent [19]

Abo et al.

[11] 4,294,216

[45] Oct. 13, 1981

[54] AIR FUEL RATIO CONTROLLING DEVICE

[75] Inventors: Toshimi Abo; Akio Hosaka, both of Yokohama, Japan

[73] Assignee: Nissan Motor Company, Limited, Yokohama, Japan

[21] Appl. No.: 101,551

[22] Filed: Dec. 7, 1979

[30] Foreign Application Priority Data

Dec. 8, 1978 [JP] Japan ..... 53-151011

[51] Int. Cl.[3] ..... F02B 3/08; F02M 7/12

[52] U.S. Cl. ..... 123/489; 123/440

[58] Field of Search ..... 123/440, 489

[56] References Cited

U.S. PATENT DOCUMENTS

| | | | |
|---|---|---|---|
| 3,923,016 | 12/1975 | Hoshi | 123/489 |
| 4,187,806 | 2/1980 | Schnurle et al. | 123/489 |
| 4,214,558 | 7/1980 | Nishioka et al. | 123/489 |
| 4,214,563 | 7/1980 | Hosaka | 123/440 |
| 4,226,221 | 10/1980 | Asano | 123/440 |
| 4,237,829 | 12/1980 | Asano et al. | 123/489 |

FOREIGN PATENT DOCUMENTS

| | | | |
|---|---|---|---|
| 52-43030 | 4/1977 | Japan | 123/489 |
| 2037021 | 7/1980 | United Kingdom | 123/489 |

*Primary Examiner*—P. S. Lall

*Attorney, Agent, or Firm*—Schwartz, Jeffery, Schwaab, Mack, Blumenthal & Koch

[57] ABSTRACT

An air fuel ratio controlling device able to exhaust gas purification efficiently by shortening the time for judgement of starting of the closed loop control by adjusting the current supply in a small extent to be fed to an exhaust gas sensor.

3 Claims, 11 Drawing Figures

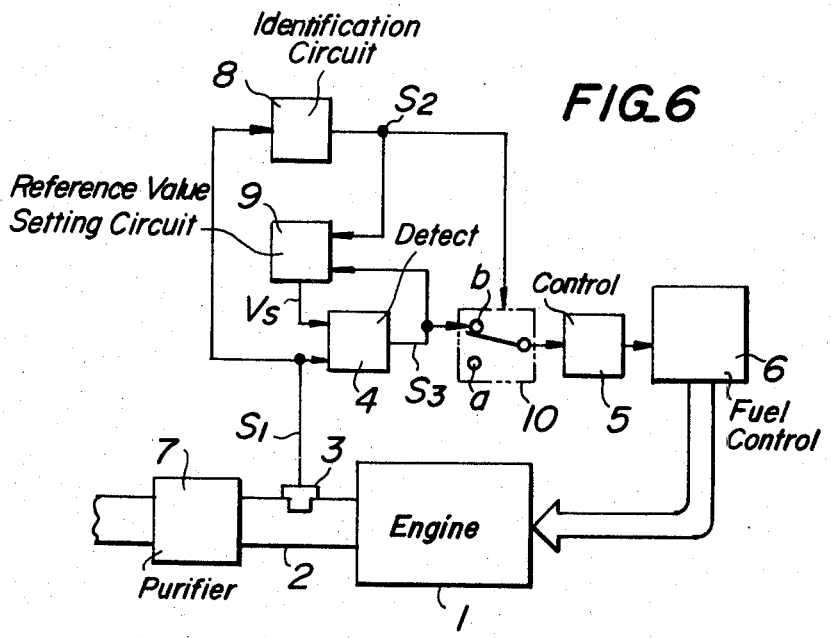
FIG.8
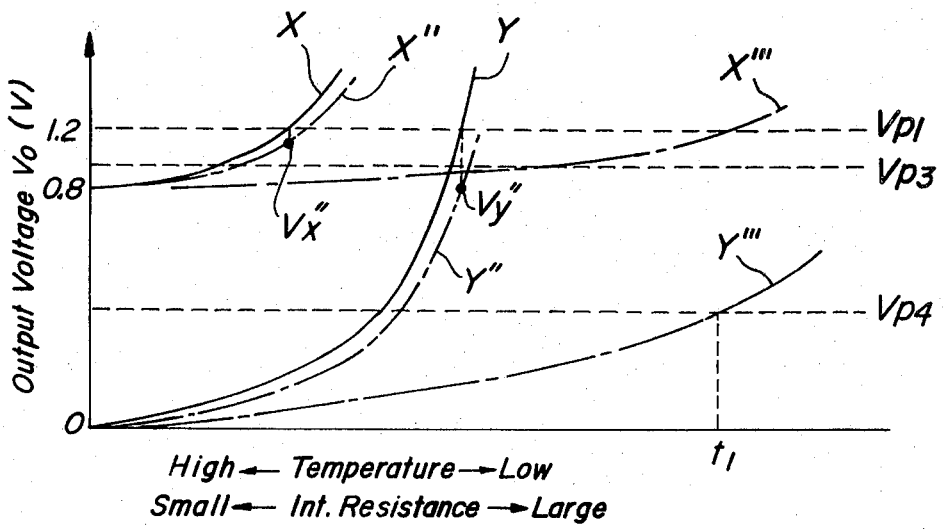

AIR FUEL RATIO CONTROLLING DEVICE

BACKGROUND OF THE INVENTION

The present invention relates to an air fuel ratio controlling device of an internal combustion engine. More particularly, the present invention relates to an identification facility for rich and lean at starting of the closed loop control in this system.

As a means for decreasing harmful exhaust gas of an automobile, it has been proposed recently an air fuel ratio controlling device based on a feedback control principle, in which the air fuel ratio is controlled based on an information concerning the concentration of the exhaust gas content of the engine.

FIG. 1 shows one embodiment of such a feedback system. In this system, the concentration of the exhaust gas content, including for instance $O_2$, CO, $CO_2$, HC, $NO_x$, etc. is detected by an exhaust gas sensor 3 provided in the exhaust pipe 2. The output signal of the sensor 3 is compared with a reference value $V_s$, which is for instance a value corresponding to a settled air fuel ratio in a deviation detecting circuit 4 consisting for instance of a differential amplifier, a comparator, etc. and the deviation is detected. By using a control circuit 5, a control signal corresponding to said deviation is produced. This control signal may be an electric signal being in proportion to the deviation, an integrated signal being an integration of the deviations, or a signal being an addition of the both signals. The amount of the fuel supply and the air supply may be additionally controlled by using the above control signal by a fuel amount adjusting or controlling device 6, which may be a carburetter, or a fuel injection means, so that the air fuel ratio of the mixed gas to be supplied to the engine 1 is maintained at a predetermined settled ratio. It is obvious that the fuel amount adjusting device 6 is controlled by a separate factor such as control of the throttle valve by the driver.

If the settled value of the air fuel ratio is adjusted to be one to match with the most suitable operational point of the exhaust gas purifier 7, which may be a catalyst means, a reactor or the like, the harmful component in the exhaust gas can efficiently be decreased.

If a ternary catalyst device, which acts to oxidize CO and HC and simultaneously acts to reduce $NO_x$, the settled air fuel ratio is set at a value near a stoichiometric air fuel ratio.

The exhaust gas sensor used in the aforementioned air fuel ratio control device generally varies its characteristics by the temperature. For instance in a Zirconia oxygen concentration meter widely used in this field has an equivalent electric circuit as shown in FIG. 2. This equivalent circuit comprises a series arrangement of a battery having varying electromotive force e according to the oxygen concentration and an internal resistance having varying internal resistance $\rho$ according to the temperature. The value of the internal resistance $\rho$ has a temperature characteristic as shown in FIG. 3. As can be seen from FIG. 3, the internal resistance $\rho$ becomes a large value at low temperature so that it becomes difficult to derive the electromotive force e. Due to this feature, the air fuel ratio controlling device is required to operate under open loop control, in general to keep it at a certain condition, at a time of low temperature of the exhaust gas sensor and to shift it to the closed loop control, i.e. feedback control, after the exhaust gas sensor becomes a temperature sufficiently high for its operation.

As a method to detect the temperature of the exhaust gas sensor it has been known to use variation of the internal resistance. In this method, a current is applied to flow through the exhaust gas sensor and the voltage variation according to the variation of the internal resistance by the temperature change is detected.

If a certain current i is assumed to flow in the exhaust gas sensor, the output voltage $V_O$ of the exhaust gas sensor can be expressed as follows.

$$V_O = e + \rho i \tag{1}$$

In the above equation (1), if the internal resistance $\rho$ becomes small according to the temperature rise, the voltage $V_O$ also decreases. Therefore, the closed loop control may be started when $V_O$ becomes less than a certain value.

However, there is still difficult problem at the time of start of the closed loop control.

It is known that the reference value $V_s$ in the deviation detecting circuit 4 is better to be varied according to the condition of the output of the exhaust gas sensor rather than to fix it at a certain fixed value. In this case, a benefit is obtained in that the variation of the output of the exhaust gas sensor may effectively be compensated at the time of low temperature or at deterioration of the sensor.

As the method for varying the reference value $V_s$ according to the condition of the output of the exhaust gas sensor, it has been known to take a mean value of the largest value (value under too rich mixed gas) and the smallest value (value under too lean mixed gas) and the mean value is used as the reference value $V_s$. However, before starting the closed loop control as mentioned in the foregoing, the output of the exhaust gas sensor is either the largest value or the smallest value so that it is impossible to obtain the mean value between the largest and the smallest values at such time before starting the closed loop control. Accordingly, there was considered a system to decide the ference value $V_s$ at a value decreased by a certain amount from the largest value if the output of the exhaust gas sensor is the largest one at the time before the start of the closed loop control and at a value increased by a certain amount from the smallest value if the output is the smallest. Therefore the mean value of the largest and smallest values of the sensor output is used as the reference value. According to this system, the reference value $V_s$ always lies in a range between the largest and the smallest values so that a proper feedback control is effectied automatically after starting thereof.

However, the above system still has a problem in that an accurate judgement is requested whether the output of the exhaust gas sensor is the largest or the smallest value, or in other words whether the mixed gas is rich or lean before starting of the closed loop control. If the reference value is erroneously increased even the mixed gas is rich, the mixed gas is deviated towards rich side and in the opposite case it is deviated towards lean side so that a proper feedback control cannot be realized.

For solving the aforementioned problem, a further method had been considered which will be explained by referring to FIG. 4.

FIG. 4 is a diagram for showing a relation between the output voltage of the exhaust gas sensor, the temperature and the internal resistance thereof in a system in which an outer supply current is fed therethrough.

In FIG. 4, a curve X shows an output voltage of the sensor applied with the current and when the mixed gas is too rich, a curve X' shows an output voltage in which the outside current supply is discontinued at the above time, a curve Y shows an output voltage of the sensor applied with the current and when the mixed gas is too lean, and a curve Y' shows an output voltage when the current is discontinued at the above time.

We assume that the starting time for the closed loop control is at a time when the output voltage $V_O$ being applied with current becomes as.

$V_O \leqq V_{p1}$ (For instance $V_{p1}$ may be 1.2 V)

Namely the above condition exists at a time when either the curve X or the curve Y becomes below the settled value $V_{p1}$.

In this case if we discontinue the current supply at a time when the curve X or the curve Y crosses the settled value $V_{p1}$, the output voltage $V_O$ decreases from $V_x$ to $V_y$. Since there is a considerable difference between the values $V_x$ and $V_y$ so that a second settled value $V_{p2}$ is determined between the curves X' and Y' and the output voltage $V_O$ when cutting off the current supply is compared with the value $V_{p2}$. By this way the rich or lean of the mixed gas then is judged more accurately. Based on the result of the judgement, the reference value is further adjusted. Namely, if the mixed gas is too rich, a value lower than $V_{p1}$ by a certain value is taken up to be the reference value $V_s$ and if it is too lean a value higher than $V_{p1}$ by a certain value is taken up as the reference value $V_s$. Then the current is again applied. In this case, the reference value $V_s$ always becomes between the curve X and the curve Y. The automatic feedback control is effected properly thereafter.

However, this system must have a quite complicated procedure in that the current is discontinued after a judgement for the possibility of start of closed loop control, that a judgement for too rich or too lean is made, that a reference value $V_s$ is decided based on the same and that the closed loop control is started after the current is supplied again. Moreover when the current is switched ON or OFF condition, it requires a certain time before the output voltage $V_O$ varies from the curves X, Y to curves X', Y' or reversely (a time during which the engine may rotate some tens of times) so that the judgement should be delayed over the above period. This means that the starting time of the closed loop control is delayed for the above period and the exhaust gas purifying characteristics deteriorate during the above period.

SUMMARY OF THE INVENTION

The present invention is to improve the aforementioned problems in the conventional system. The invention has its object to realize an air fuel ratio controlling device being able to improve the exhaust gas purifying facility by shortening the time for judgement of the starting of the closed loop control by arranging the current applied to the exhaust gas sensor to be smaller by a certain amount at the time of starting the closed loop control so that the initial value of the previously settled reference value becomes smaller than the maximum value of the output of the exhaust gas sensor and larger than the smallest value thereof automatically.

BRIEF DESCRIPTION OF THE DRAWINGS

FIG. 6 and FIG. 7 are simplified system diagrams of embodiments of the present invention;

FIG. 8 is an output voltage characteristics of the device shown in FIG. 7;

DESCRIPTION OF THE PREFERRED EMBODIMENTS

The invention will now be described by referring to the accompanying drawings.

At first the principle of the invention will be explained by using diagram shown in FIG. 5.

Figure 5:
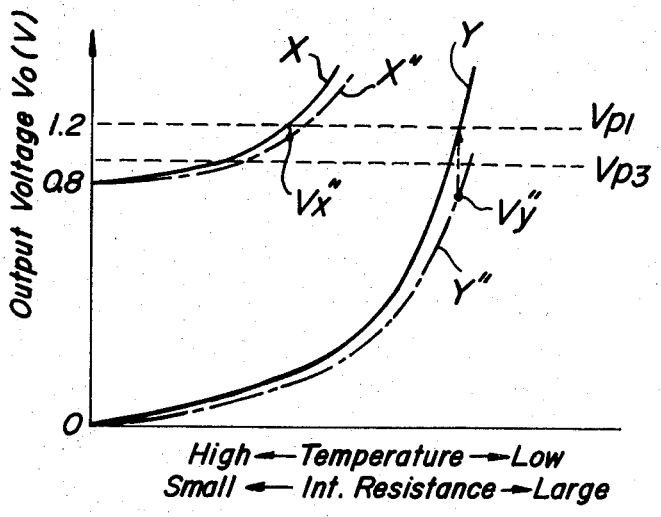

In FIG. 5, curves X and Y are output voltages when the current is applied. Curves X' and Y' are output voltages when the current is decreased by $\Delta i$ from the proper value.

The starting point of the closed loop control is assumed at the output voltage $V_O$ being $V_O \leqq V_{p1}$ (for instance 1.2 V) with current. If the current is decreased by a certain value $\Delta i$ when the curve X or Y crosses $V_{p1}$, the output voltage decreases from $V_{p1}$ to $V''_x$ or $V''_y$. Based on the value of $\Delta i$, the values of $V''_x$ and $V''_y$ can be assumed previously so if the value $V_{p3}$ as the reference value $V_s$, wherein $V''_x > V_{p3} > V''_y$, a proper closed loop control can be effected automatically. According to this principle, it is quite different to make ON-OFF of the current supply completely, the time lag can be made very small since the current is decreased only by $\Delta i$. The initial value of the reference value $V_s$ can always be a certain value so that the circuit may be formed in a very simple manner. The initial value of the above reference may previously set by, for instance, experiments.

An embodiment of the present invention will be explained by referring to FIG. 6.

Figure 1:
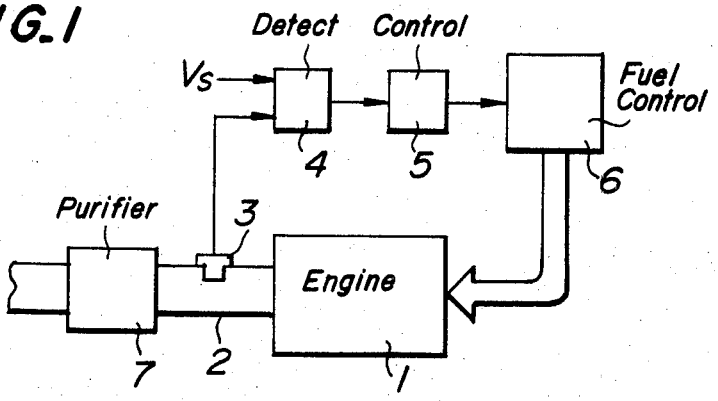
FIG. 1 is a simplified diagram for showing one embodiment of the air fuel ratio controlling device to which the present invention may be applied.
Figure 2:
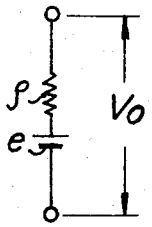
FIG. 2 is an equivalent diagram of an exhaust gas sensor.
Figure 3:
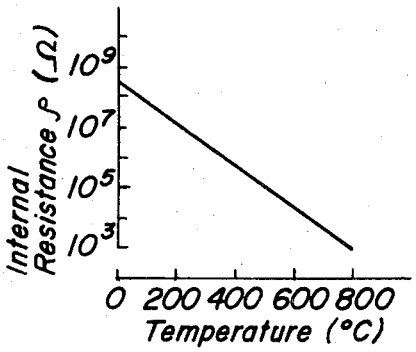
FIG. 3 is a temperature characteristic of its internal resistance.

In FIG. 6, the same members are shown by same reference numerals as in FIG. 1. Namely an exhaust gas sensor 3 is provided in an exhaust tube 2 between an engine 1 and a purifier 7. An output of the sensor 3 is compared with a reference value $V_s$ in a detecting circuit 4 and a control circuit 5 controls a fuel adjusting device 6 based on the detected amount of deviation.

In the present invention, as shown in FIG. 6, a switching circuit 10 is inserted between the detecting circuit 4 and the control circuit 5. During open loop control such as at low temperature, this switching circuit 10 acts to disconnect between the detecting circuit 4 and the control circuit 5 by placing the switching arm towards a contact a. Accordingly, the control signal delivered from the control circuit 5 is maintained at a constant value and an open loop control is effected as the feedback loop is interrupted. An identification circuit 8 is provided between the sensor 3 and the switching circuit 10. This indentification circuit 8 include a supply circuit for supplying current to the exhaust gas sensor 3. The identification circuit 8 normally supplies a predetermined current to the exhaust gas sensor 3 and the voltage $V_O$ in the output of the exhaust gas sensor 3 in the above condition is compared with a settled value $V_{p1}$. If a condition $V_O \leqq V_{p1}$ is reached, it acts to decrease the current supply by $\Delta i$ and at the same time it delivers a closed loop control starting signal $S_2$ to a reference value setting circuit 9 and to the switching circuit 10. Upon receipt of said signal $S_2$, the reference value setting circuit 9 sets initial value of the reference value $V_s$ as $V_{p3}$ and delivers it to the deviation detecting circuit 4. In this case, the value $V_{p3}$ is previously selected to lie in the range between the maximum value $V''_x$ and the minimum value $V''_y$ of the output of the exhaust gas sensor as has been described hereinbefore so that a proper judgement for rich or lean is effected automatically. By the above closed loop control starting signal $S_2$, the switching circuit 10 is now switched to the side of a contact b to complete a closed loop and the closed loop control is now started. When the closed loop control is started, the reference value setting circuit 9 detects the maximum and the minimum values of the deviation signal $S_3$ and it delivers a value corresponding the above, for instance, the mean amount of the maximum and the minimum values, to the deviation detecting circuit 4 as the reference value $V_s$ and the normal closed loop control is effected thereafter.

Figure 7:
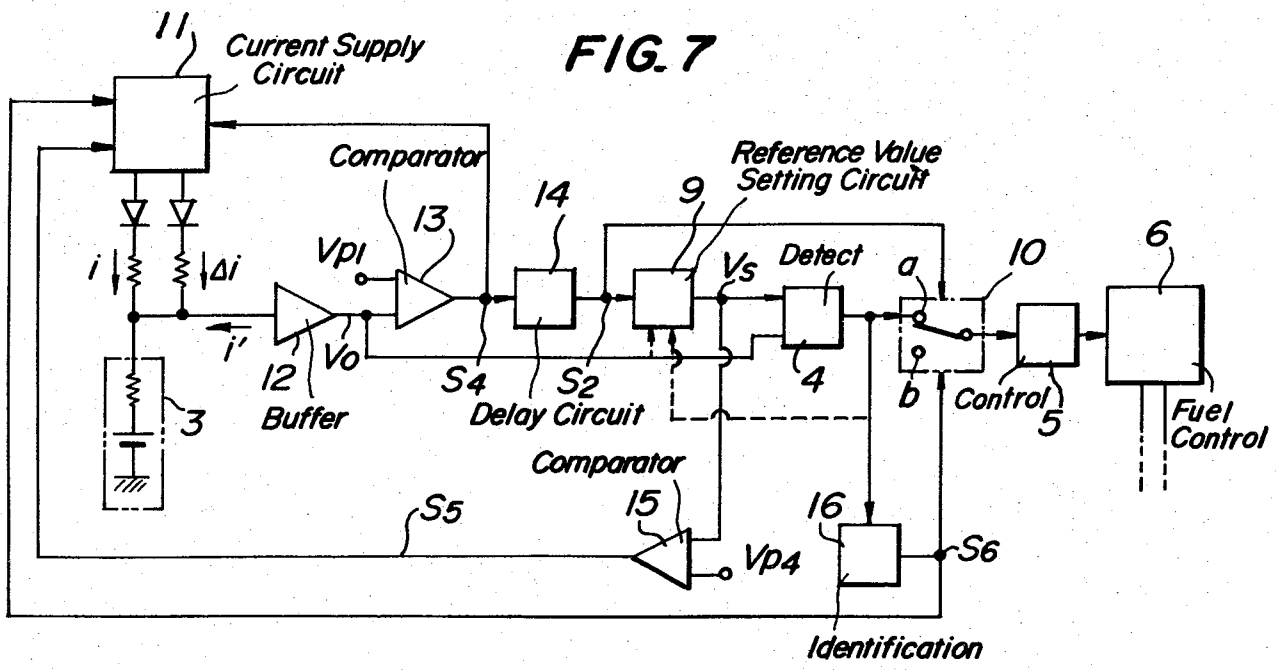

FIG. 7 shows another embodiment of the present invention and FIG. 8 is a characteristic diagram of the circuit of FIG. 7.

By referring to FIG. 7, 12 indicates a buffer circuit. If this buffer circuit 12 is formed as an operational amplifier having PNP type input, it has a small leakage current of about several tens to hundreds nA and the leakage current flows into the sensor 3.

A current supply circuit 11 act to feed for the exhaust gas sensor 3 via series circuits of a diode and a resistor, the currents of i and $\Delta i$ respectively. The current fed to the exhaust gas sensor 3 is expressed by:

$$i+\Delta i+i'$$

Now referring to FIG. 8, curves X and Y, X'' and Y'', and X''' and Y''' represent respectively of the characteristics of the output voltage $V_O$ in the following cases.

X,Y—supply current is $i+\Delta i+i'$ (normal case)

X'', Y''—supply current is $i+i'$ (decreased by $\Delta i$)

X''',Y'''—supply current is $i'$ (all the supply current from circuit 11 have been discontinued)

Figure 4:
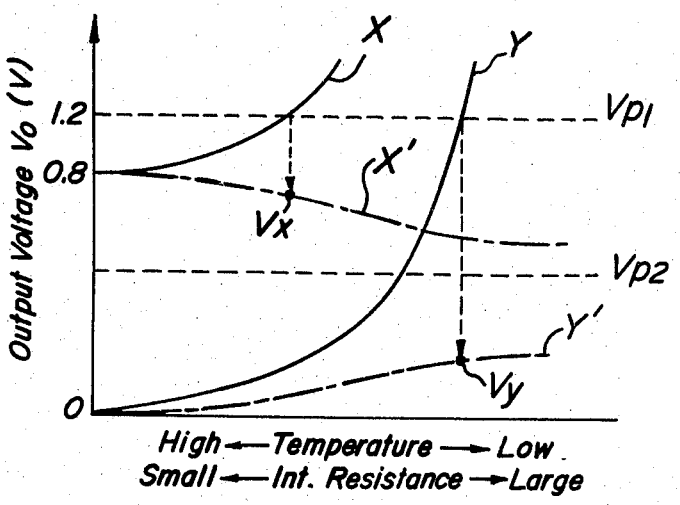
FIG. 4 and FIG. 5 are diagrams for showing temperature characteristic of the output voltage thereof.

In case of the circuit shown in FIG. 7, even all the supply current from the supply circuit 11 is discontinued, the supply current to the exhaust gas sensor 3 will not reach to a perfect zero since there is a leakage current $i'$ from the buffer circuit 12. According to this reason, the curves X''' and Y''' in FIG. 8, when the supply current is discontinued, differ from curves X' and Y' in FIG. 4 at the time of such discontinuation of current.

In the circuit of FIG. 7 in case of open loop control, the switching circuit 10 is placed at the side of the contact a and at this time the supply circuit 11 applies a current of $i+\Delta i$. Accordingly a current of $i+\Delta i+i'$ flows through the exhaust gas sensor 3. The output voltage $V_O$ of the exhaust gas sensor 3 is placed above curves X and Y in FIG. 8.

A comparator 13 compares the output of the buffer circuit 12, which is same as the output voltage $V_O$ of the exhaust gas sensor, with the settled voltage $V_{p1}$ and delivers output signal $S_4$ when a condition: $V_O \leqq V_{p1}$ is reached.

The current supply circuit 11 discontinues the current $\Delta i$ when the signal $S_4$ is given and to make the current as i.

A delay circuit 14 connected to the output of the comparator 13 delivers a signal $S_2$ a delay signal of signal $S_4$ delayed by a delay time $\tau_4$. A reference value setting circuit 9 delivers an initial value $V_s = V_{p3}$ of the reference value when the signal $S_2$ is given thereto. At the same time, the switching circuit 10 is switched to the side of the contact b and closed loop control is now started.

The abovementioned delay time $\tau_1$ is provided in order to wait stabilization of the output voltage of the exhaust gas sensor after decreasing the current supply. The time required before stabilization becomes very much shorter if compared with the conventional case in which the supply current is completely disconnected.

Then if the closed loop control is started, a reference value setting circuit 9 delivers a value corresponding to the output of the exhaust gas sensor, for instance a mean value between the maximum and minimum values, as the ference value $V_s$.

If the temperature of the exhaust gas sensor increases, the output voltage $V_O$ of the exhaust gas sensor gradually decreases along the curves X'' and Y'', i.e. moves toward left in the drawing. The reference value $V_s$ decreases accordingly.

A comparator 15 compares the value $V_s$ with a setting value $V_{p4}$. This value $V_{p4}$ is for instance a mean value between the maximum and minimum values at normal operational temperature and is for instance 0.4 V. If a condition $V_s \leqq V_{p4}$ is reached, the comparator 15 delivers an output signal $S_5$ by judging that the exhaust gas sensor became at a sufficiently high temperature. The current supply circuit 11 completely discontinues the supply current when the signal $S_5$ is given. Accordingly the current given to the exhaust gas sensor is now only the leakage current $i'$. The output voltage $V_O$ of the exhaust gas sensor is in the region between the curves X''' and Y'''. In this case the reference value $V_s$ is fixed at the value $V_{p4}$. As can be seen from FIG. 8, the curves X'' and X''' are very close each other and also the curves Y'' and Y''' are very close each other so that the output voltage of the exhaust gas sensor does not vary very much even the current supply i is disconnected.

As has been mentioned in the foregoing the power consumption can be saved by stopping the current supply at high temperature.

During the closed loop control, if the temperature of exhaust gas sensor decreases by a reason of a long term idling or the like, it is necessary to effect an open loop control again.

There may be several ways for identifying the necessity of such a switching from the closed loop control to the open loop control. For instance there is a system in which the judgement is made based on the amplitude of the output voltage of the exhaust gas sensor. Namely by using the difference between the maximum and minimum values, the judgement is made to switch to the open loop control when the amplitude becomes below a certain value. However, in the circuit as shown in FIG. 7, there is a leakage current $i'$ flowing through the sensor 3 even the current supply is discontinued so that by using the leakage current the judgement for the low temperature time can be effected. Namely, the identification circuit 16, consists of for instance of a holding circuit and a comparator, supervises the deviation signal delivered from the deviation detecting circuit 4. The circuit 16 delivers signal $S_6$ when the deviation signal becomes a certain value over the reference value $V_s$ (at this time $V_s$ is fixed at $V_{p4}$, i.e. $V_s = V_{p4}$) and kept at said certain value over a predetermined period. This means that the output voltage $V_O$ of the exhaust gas sensor becomes higher than $V_{p4}$ even under lean mixed gas (right side from $t_1$ in FIG. 8). By this signal $S_6$, the switching circuit 10 is switched to the contact a side and the system is switched to an open loop control and the current supply circuit 11 again starts to supply a current of $i+\Delta i$.

In the circuit of FIG. 7, the leakage current i' of the buffer circuit 12 is utilized. However, if there is no such leakage currrent, the value of outer supply current of the supply circuit 11 may be changed to three steps of "i", "$I+\Delta i$", and "$i+\Delta i+i'$".

Figure 9:
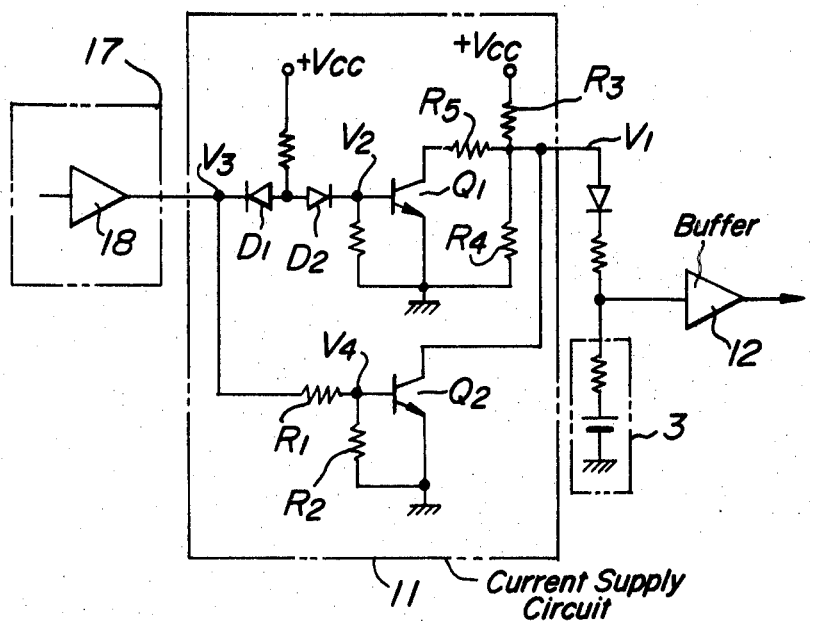
FIG. 9 is a circuit diagram for supplying the current.

FIG. 9 shows one embodiment of the current supply circuit 11. The circuit is controlled by a micro computer 17 which includes a portion corresponding to the control circuit 5 that the reference value setting circuit 9.

In this case, the micro computer 17, the output circuit of the signals to be given to the supply circuit 11 such as $S_4$, $S_5$, $S_6$ of FIG. 7, may be formed of a three state buffer 18.

The three state buffer 18 is a buffer circuit of which output may assume three conditions namely, "1", "0" and "High Impedance". In general an output circuit of a micro computer is formed in such form.

Referring to FIG. 9, when "1" output signal (corresponding to $S_5$) is delivered from the three state buffer 18, both the transistors $Q_1$ and $Q_2$ become ON so that the voltage $V_1$ at the output terminal of the supply circuit 11 becomes substantially 0 V and the outer supply current becomes 0.

When the output of the three state buffer 18 is "0" (corresponding to $S_4$), both the transistors $Q_1$ and $Q_2$ become OFF and $$V_1 = V_{cc} \times \frac{R_4}{R_3 + R_4}$$

so that a large current (above $i+\Delta i$) is applied to flow through the sensor.

Next when the output of the three state buffer 18 is "High Impedance" (corresponding to $S_6$), the transistor $Q_1$ becomes ON and the base terminal voltage $V_2$ becomes equal to the base emitter voltage $V_{EB}$ of about 0.6 V. Since the voltage drop across the diode $D_1$ and that across the diode $D_2$ compensate each other, the voltage $V_2$ becomes equal to the voltage or potential $V_3$. Base potential $V_4$ of the transistor $Q_2$ becomes equal to the voltage $V_3$ divided by a ratio of resistors $R_1$ and $R_2$ so that this transistor $Q_2$ becomes OFF. Therefore the following relation exists and the supply current then corresponds to the aforementioned i.

$$V_1 = \frac{R_4R_5}{R_3R_4 + R_4R_5 + R_5R_3} \times V_{cc}$$

Figure 10:
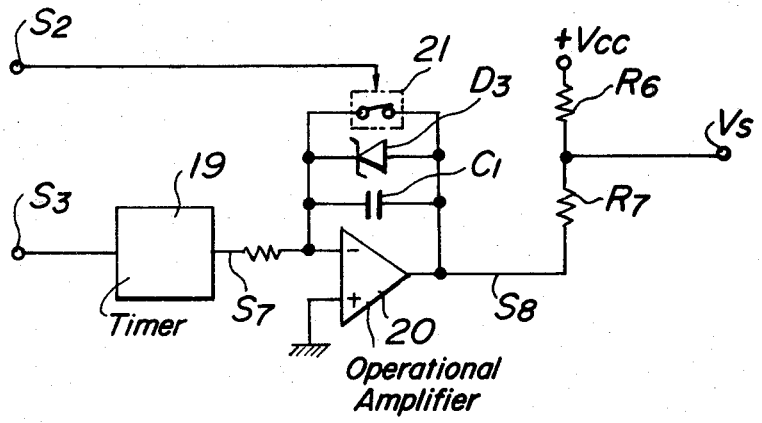
FIG. 10 is one embodiment of the reference value setting circuit.
Figure 11:
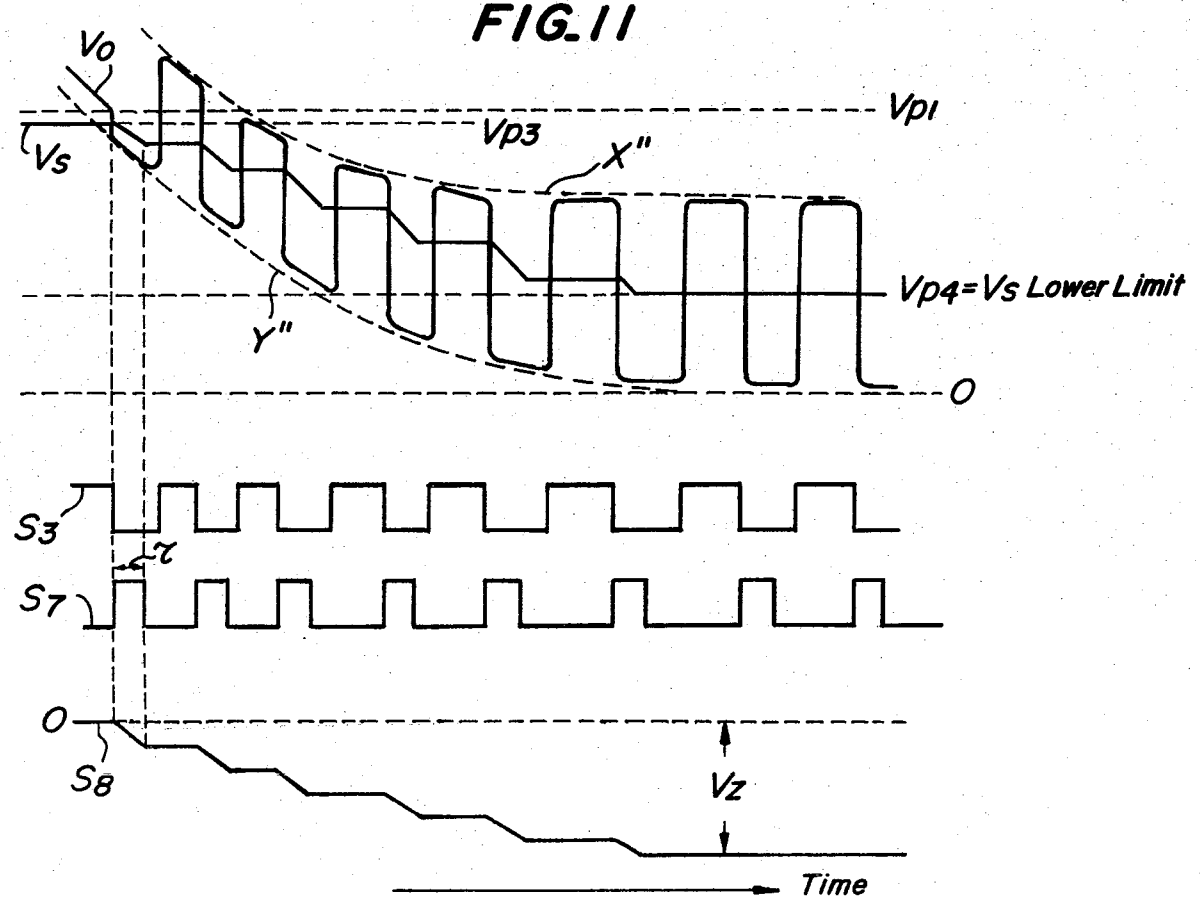
FIG. 11 is a signal waveform diagram of the circuit shown in FIG. 10.

FIG. 10 illustrates one embodiment of the reference value setting circuit 9. FIG. 11 shows signal waveforms in the circuit of FIG. 10.

Referring to FIG. 10, an operational amplifier 20, a condenser $C_1$ and a zener diode $D_3$ form an integrator having lower limit value. This integrator will not make the integrating action before opening of a switch 21 connected in parallel to the zener diode $D_3$ by the signal $S_2$ and the output is 0 V. In this condition the reference value $V_s$ is equal to a potential between the source voltage $V_{cc}$ and 0 V divided by a ratio of resistors $R_6$ and $R_7$. The resistors $R_6$ and $R_7$ are so selected that the voltage $V_s$ at the above condition becomes equal to the aforementioned value $V_{p3}$.

If the closed loop control is started, the switch 21 is opened by the signal $S_2$ so that an integrating operation of the integrator now becomes possible. If the signal $S_3$ of the deviation detecting circuit 4 indicates lean condition of the air fuel ratio (low level) at such time, a timer 19 is started and it delivers a high level signal $S_7$ for a predetermined term $\tau$ to the integrator circuit.

The integrator circuit integrates the signal $S_7$ delivered from the timer 19 and delivers signal $S_8$ at its output. This integrating operation is continued until the output voltage reaches to the zener voltage $V_z$ of the zener diode $D_3$. If the integrated output $S_8$ reaches to the zener voltage $V_z$, further integrating operation is disconnected and this value determines lower limit value, i.e. $V_{p4}$ of the reference value $V_s$. The applicant had suggested already to add a circuit being able to keep the reference value $V_s$ to lie in a range between the exhaust gas sensor output voltage X'' under rich mixed gas and output voltage Y'' under lean mixed gas by decreasing the reference value $V_s$ or keeping it at a certain constant value irrespective to the value of the deviation signal $S_3$ if there is any possibility that the reference value $V_s$ becomes over X'' or below Y''. Furthermore the reference value $V_s$ may be set at an intermediate value between upper and lower peak values of the exhaust gas sensor as has been mentioned in the foregoing.

As explained above, according to the present invention, the judgement of rich and lean of the mixed gas can be effected speedy and accurately at the starting time of the closed loop control. Due to the above feature the closed loop control may be started in a possible earliest term. This would result an improvement of purifying characteristics of the exhaust gas. Furthermore the judgement for the transition from the closed loop control to the open loop control can be made easily and accurately.

What is claimed is:

1. An air fuel ratio controlling device comprising an exhaust gas sensor for detecting composition and concentration of exhaust gas of an engine, and a means for delivering a deviation signal based on a deviation between an output of said exhaust gas sensor and a reference value, the air fuel ratio of mixed gas to be supplied to the engine is feedback controlled by a control signal based on said deviation signal and the reference value is varied to match with condition of the output of the exhaust gas sensor, an improvement lies in that the device comprising a means for switching outer supply current to the exhaust gas sensor when an output voltage of the exhaust gas sensor during supply of a current of a first predetermined value becomes less than a certain predetermined value to a second predetermined value smaller than said first predetermined value and for starting feedback control from such time, and a means for previously setting an intermediate value lying between an expected value $V''_x$ of the output voltage of the exhaust gas sensor when the mixed gas is too rich and an expected value $V''_y$ of the same is too lean at a time of switching from said first predetermined value to said second predetermined value under the situation of too rich or too lean mixed gas and applying said intermediate value as an initial value of said reference value.

2. An air fuel ratio controlling device comprising an exhaust gas sensor for detecting composition and concentration of exhaust gas of an engine, and a means for delivering a deviation signal based on a deviation between an output of said exhaust gas sensor and a reference value, the air fuel ratio of mixed gas to be supplied to the engine is feedback controlled by a control signal based on said deviation signal and the reference value is varied to match with condition of the output of the exhaust gas sensor, an improvement lies in that the device comprising a means for switching outer supply current to the exhaust gas sensor when an output voltage of the exhaust gas sensor during supply of a current of a first predetermined value becomes less than a certain predetermined value to a second predetermined value smaller than said first predetermined value and for starting feedback control from such time, a means for previously setting an intermediate value lying between an expected value $V''_x$ of the output voltage of the exhaust gas sensor when the mixed gas is too rich and an expected value $V''_y$ of the same is too lean at a time of switching from said first predetermined value to said second predetermined value under the situation of too rich or too lean mixed gas and applying said intermediate value as an initial value of said reference value, and a means for discontinuing the current supply when the reference value becomes less than a setting value determined around an intermediate point between output voltages of the exhaust gas sensor for too rich and too lean mixed gas at a time when the sensor is high temperature.

3. An air fuel ratio controlling device comprising an exhaust gas sensor for detecting composition and concentration of exhaust gas of an engine, and a means for delivering a deviation signal based on a deviation between an output of said exhaust gas sensor and a reference value, the air fuel ratio of mixed gas to be supplied to the engine is feedback controlled by a control signal based on said deviation signal and the reference value is varied to match with condition of the output of the exhaust gas sensor, an improvement lies in that the device comprising a means for switching outer supply current to the exhaust gas sensor when an output voltage of the exhaust gas sensor during supply of a current of a first predetermined value becomes less than a certain predetermined value to a second predetermined value smaller than said first predetermined value and for starting feedback control from such time, a means for previously setting an intermediate value lying between an expected value $V''_x$ of the output voltage of the exhaust gas sensor when the mixed gas is too rich and an expected value $V''_y$ of the same is too lean at a time of switching from said first predetermined value to said second predetermined value under the situation of too rich or too lean mixed gas and applying said intermediate value as an initial value of said reference value, a means for switching value of the supply current from said second predetermined value to a third predetermined value which is a very small value compared with said second predetermined value when the reference value becomes less than a first setting value determined around an intermediate point between output voltages of the exhaust gas sensor for too rich and too lean mixed gas at a time when the sensor is high temperature and simultaneously fixing the reference value to said first setting value, and a means for discontinuing the feedback control when the value of the output voltage of the exhaust gas sensor under lean mixed gas during the feedback control becomes higher than said first setting value and simultaneously returning the value of the outer supply current to said first predetermined value.

* * * * *